US009611768B2

(12) United States Patent
Ha

(10) Patent No.: US 9,611,768 B2
(45) Date of Patent: Apr. 4, 2017

(54) CONTINUOUS VARIABLE VALVE DURATION APPARATUS

(71) Applicant: Hyundai Motor Company, Seoul (KR)

(72) Inventor: Kyoung Pyo Ha, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 100 days.

(21) Appl. No.: 14/500,283

(22) Filed: Sep. 29, 2014

(65) Prior Publication Data

US 2015/0167508 A1 Jun. 18, 2015

(30) Foreign Application Priority Data

Dec. 18, 2013 (KR) ..... 10-2013-0158585

(51) Int. Cl.
*F01L 1/46* (2006.01)
*F01L 13/00* (2006.01)

(52) U.S. Cl.
CPC ..... *F01L 13/0015* (2013.01)

(58) Field of Classification Search
CPC ..... F01L 13/0063; F01L 13/00; F01L 2013/0084; F01L 13/0026; F01L 1/344; F01L 1/34
USPC ..... 123/90.16
See application file for complete search history.

(56) References Cited

U.S. PATENT DOCUMENTS 4,131,096 A 12/1978 Mitchell
5,333,579 A 8/1994 Hara et al.
5,365,896 A * 11/1994 Hara ..... F01L 1/356 123/90.17
5,494,009 A 2/1996 Yamada et al.
5,553,573 A 9/1996 Hara et al.
5,557,983 A 9/1996 Hara et al.
5,592,908 A 1/1997 Hara et al.
5,622,144 A 4/1997 Nakamura et al.
5,636,603 A 6/1997 Nakamura et al.
5,645,020 A * 7/1997 Yamada ..... F01L 1/0532 123/90.17
5,687,681 A 11/1997 Hara
5,709,179 A 1/1998 Hara et al.
5,778,840 A 7/1998 Murata et al.
5,924,334 A 7/1999 Hara et al.
5,937,805 A * 8/1999 Matsumura ..... F01L 1/34 123/90.15
6,401,675 B1 6/2002 Nakamura et al.
6,425,357 B2 7/2002 Shimizu et al.
6,427,653 B1 8/2002 Hara et al.
(Continued)

FOREIGN PATENT DOCUMENTS

DE 10306154 A1 * 8/2004 ..... F01L 1/022
JP 3198772 B2 8/2001

*Primary Examiner* — Jorge Leon, Jr.
(74) *Attorney, Agent, or Firm* — Morgan, Lewis & Bockius LLP

(57) ABSTRACT

A continuous variable valve duration apparatus may include a cam shaft rotatably mounted to a cam carrier, a cam which is disposed to the cam shaft and relatively rotatable with respect to the cam shaft, and of which a rotation center thereof is variable with respect to a rotation center of the cam shaft, a connecting link which is disposed between the cam and the camshaft, is pivotally connected at least one of the cam and the camshaft, and transmits rotation of the camshaft to the cam, and a control portion selectively changes the rotation center of the cam.

16 Claims, 7 Drawing Sheets

(56) References Cited

U.S. PATENT DOCUMENTS

| | | | |
|---|---|---|---|
| 6,874,456 | B2 | 4/2005 | Yamada et al. |
| 6,907,852 | B2 | 6/2005 | Schleusener et al. |

* cited by examiner

CONTINUOUS VARIABLE VALVE DURATION APPARATUS

CROSS-REFERENCE TO RELATED APPLICATION

The present application claims priority to and the benefit of Korean Patent Application No. 10-2013-0158585 filed on Dec. 18, 2013, the entire contents of which is incorporated herein for all purposes by this reference.

BACKGROUND OF THE INVENTION

Field of the Invention

The present invention relates to a continuous variable valve duration apparatus. More particularly, the present invention relates to a continuous variable valve duration apparatus which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve duration apparatus which may vary opening duration of a valve according to operation conditions of an engine, with a simple construction.

In an aspect of the present invention, a continuous variable valve duration apparatus may include a cam shaft rotatably mounted to a cam carrier, a cam which is disposed to the cam shaft and relatively rotatable with respect to the cam shaft, and of which a rotation center thereof is variable with respect to a rotation center of the cam shaft, a connecting link which is disposed between the cam and the camshaft, is pivotally connected at least one of the cam and the camshaft, and transmits rotation of the camshaft to the cam, and a control portion selectively changes the rotation center of the cam.

A cam support shaped as a cylinder is formed to the cam, and the control portion may include a guide plate, and a control plate including a cam bearing of which the cam support is rotatably connected thereto, wherein the control plate selectively moves along the guide plate.

The guide plate is connected to the cam carrier, and the cam shaft is connected between the cam carrier and the guide plate.

A guide pin is formed to one of the control plate and the guide plate, and a guide rail guiding the guide pin is formed to the other one of the control plate and the guide plate.

The control portion may further include a control shaft which is parallel to the camshaft and of which an eccentric cam is mounted thereto, and a control slot is formed to the control plate for the eccentric cam to be inserted thereto and engaged thereto, and a relative position of the control plate with respect to the guide plate is changeable according to rotation of the control shaft.

The guide plate is connected to the cam carrier, and the control shaft is connected between the guide plate and the cam carrier through a control shaft bearing.

A guide hole is formed to the cam, and a first end of the connecting link is fixed to the camshaft, and a pivot head is formed to a second end of the connecting link, and the pivot head is pivotally and slidably inserted into the guide hole.

A guide hole is formed to the camshaft, and a first end of the connecting link is fixed to the cam, and a pivot head is formed to a second end of the connecting link, and the pivot head is pivotally and slidably inserted into the guide hole.

Pivot holes are formed to the camshaft and the cam respectively, and pivot heads are formed to both ends of the connecting link and are pivotally inserted into the pivot holes respectively.

A pivot hole is formed to the cam, a pivot cap, where a pivot hole is formed thereto, is connected to the camshaft, and pivot heads are formed to both ends of the connecting link and are pivotally inserted into the pivot holes respectively.

A guide slot is formed to the cam, a pivot hole is formed to the camshaft, and a first end of the connecting link is slidably inserted into the guide slot, and a pivot head is formed to a second end of the connecting link, and the pivot head is pivotally inserted into the pivot hole.

A guide slot is formed to the cam, a pivot cap, where a pivot hole is formed thereto, is connected to the camshaft, and a first end of the connecting link is slidably inserted into the guide slot, and a pivot head is formed to a second end of the connecting link, and the pivot head is pivotally inserted into the pivot hole.

A guide slot is formed to the camshaft, a pivot cap, where a pivot hole is formed thereto, is slidably inserted into the guide slot, and a first end of the connecting link is fixed to the cam, and a pivot head is formed to a second end of the connecting link, and the pivot head is pivotally inserted into the pivot hole.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
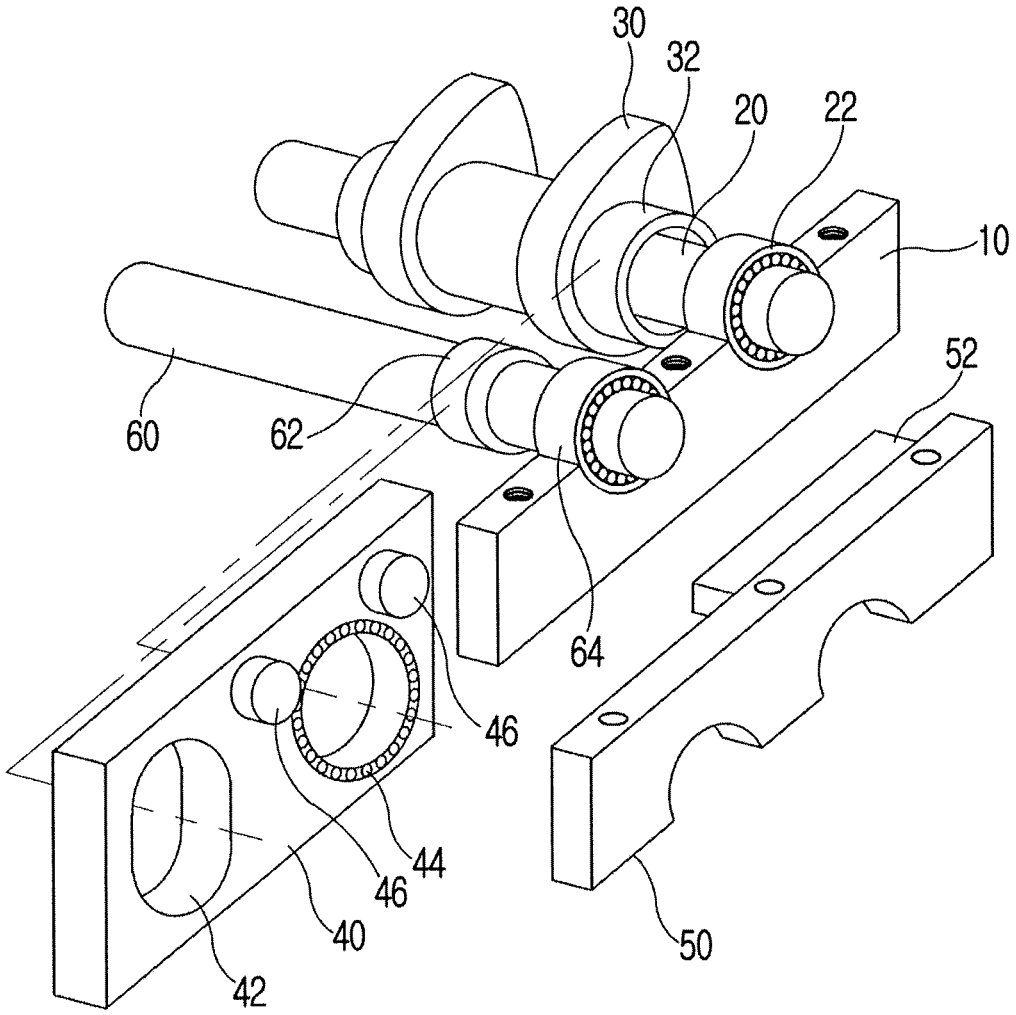
FIG. 1 is an exploded perspective view of a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

FIG. 1 is an exploded perspective view of a continuous variable valve duration apparatus according to an exemplary embodiment of the present invention, and FIG. 2 is a drawing showing operations of a continuous variable valve duration apparatus according to an exemplary embodiment of the present invention.

Referring to FIG. 1 and FIG. 2, a continuous variable valve duration apparatus according to an exemplary embodiment of the present invention includes a cam shaft 20 rotatably mounted to a cam carrier 10, a cam 30 which is disposed to the cam shaft 20 and relatively rotatable with respect to the cam shaft 20, and of which a rotation center thereof is variable with respect to a rotation center of the cam shaft 20, a connecting link (referring to 70 of FIG. 3) which is disposed between the cam 30 and the camshaft 20, is pivotally connected at least one of the cam 30 and the camshaft 20, and transmits rotation of the camshaft 20 to the cam 30, and a control portion selectively changes the rotation center of the cam 30.

Structure and function of the connecting link will be described later.

A cam support 32 shaped as a cylinder is formed to the cam 30, and the control portion includes a guide plate 50, and a control plate 40 including a cam bearing 44 of which the cam support 32 is rotatably connected thereto, The control plate selectively moves along the guide plate 50.

The guide plate 50 is connected to the cam carrier 10, and the camshaft 20 is connected between the cam carrier 10 and the guide plate 50 through the camshaft bearing 22.

A guide pin 46 may be formed to one of the control plate 40 and the guide plate 50, and a guide rail 52 or 54 guiding the guide pin 46 may be formed to the other one of the control plate and the guide plate.

In the drawing, the guide pin 46 is protruded from the control plate 40, and a plurality of the guide rails 52 and 54 are formed to the guide plate 50, but it is not limited thereto. On the contrary, the guide pin 46 may be protruded from the guide plate 50, and a plurality of the guide rails 52 and 54 may be formed to the control plate 40. And also, one guide rail 52 or 54 may be formed to guide the guide pin 46.

The camshaft 20 is rotatably disposed to the guide plate 50 through the camshaft bearing 22, and the cam 30 is rotatably disposed to the control plate 40 through the cam support 32 and the cam bearing 44. When the control plate 40 moves guided by the guide plate 50, relative rotation center of the camshaft 20 with respect to the rotation center of the cam 30 is changed so as to change relative rotation speed of the cam 30 with respect to the rotation speed of the camshaft 20.

The control portion is parallel to the camshaft 20, and further includes a control shaft 60, an eccentric cam 62 is provided thereto. And a control slot 42 is formed to the control plate 40 where the eccentric cam 62 is inserted thereto, and relative position of the control plate 40 with respect to the position of the guide plate 50 is variable according to the rotation position of the control shaft 60.

The guide plate 50 is connected to the cam carrier 10, and the control shaft 60 is mounted between the guide plate 50 and the cam carrier 10 through a control shaft bearing 64.

Hereinafter, referring to FIG. 1 and FIGS. 2A, 2B and 2C, operations of the continuous variable valve duration apparatus according to an exemplary embodiment of the present invention will be described.

Figure 2A:
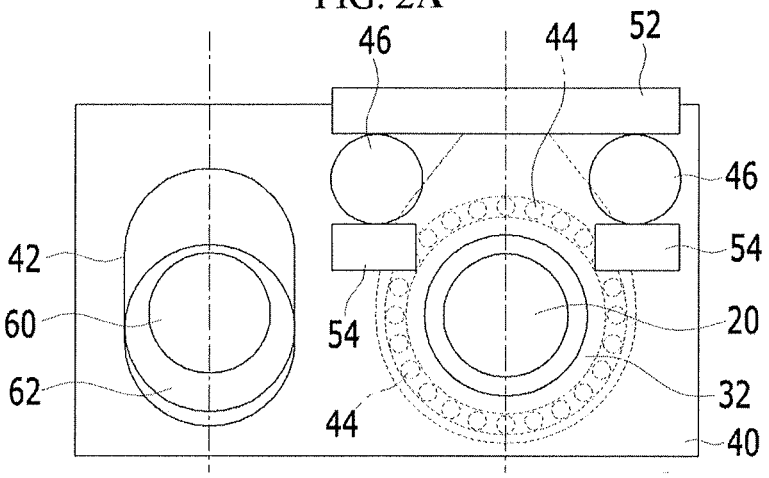
FIGS. 2A, 2B and 2C are drawings showing operations of a continuous variable valve duration apparatus according to an exemplary embodiment of the present invention.

As shown in FIG. 2A, at a normal condition (relative position change between the rotation centers of the camshaft 20 and the cam 30 is not occurred), the cam 30 rotates with phase angle as the same as the phase angle of the camshaft 20, and valve duration is not changed.

Figure 2B:
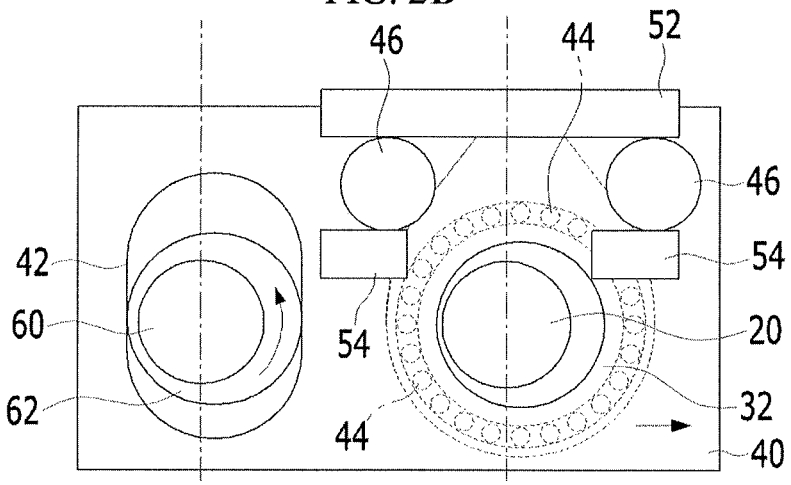

As shown in FIG. 2B, when the control shaft 60 rotates so as to move the control plate 400 to the right direction of the drawing, the relative position between the rotation centers of the camshaft 20 and the cam 30 is changed. And due to the connecting link 70, which will be described later, the cam 30 rotates with various rotation speed to realize valve duration change, for example to realize short duration.

Figure 2C:
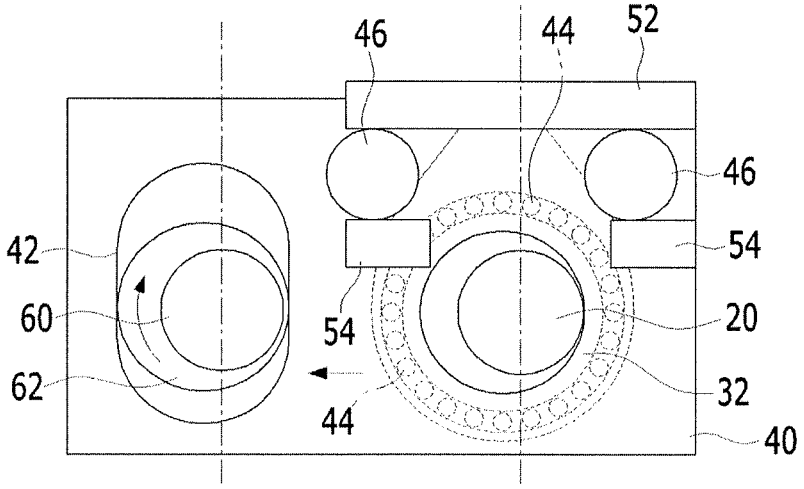

As shown in FIG. 2C, when the control shaft 60 rotates so as to move the control plate 400 to the left direction of the drawing, the relative position between the rotation centers of the camshaft 20 and the cam 30 is changed. And due to the connecting link 70, which will be described later, the cam 30 rotates with various rotation speed to realize valve duration change, for example to realize long duration.

Figure 3:
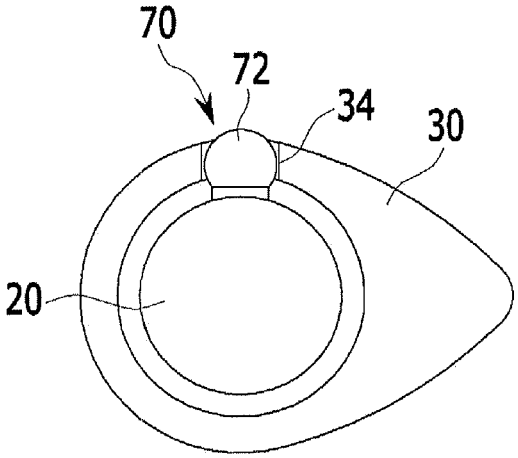
FIG. 3 is a drawing showing one exemplary connecting link applied to a continuous variable valve duration apparatus according to an exemplary embodiment of the present invention.

FIG. 3 a drawing showing one exemplary connecting link applied to a continuous variable valve duration apparatus according to an exemplary embodiment of the present invention.

Referring to FIG. 3, a guide hole 34 is formed to the cam 30, and a first end of the connecting link 70 is fixed to the camshaft 20, and a pivot head 72 is formed to a second end of the connecting link 70, and the pivot head 72 is pivotally and slidably inserted into the guide hole 34.

During the rotation of the camshaft 20, the cam 30 rotates with the connecting link 70. Because the pivot head 72 is pivotally and slidably inserted into the guide hole 34, the rotation speed of the cam 20 is variable when relative distance between the rotation centers of the camshaft 20 and the cam 30 is changed from at a predetermined distance. That is, the valve duration is changed.

Figure 4:
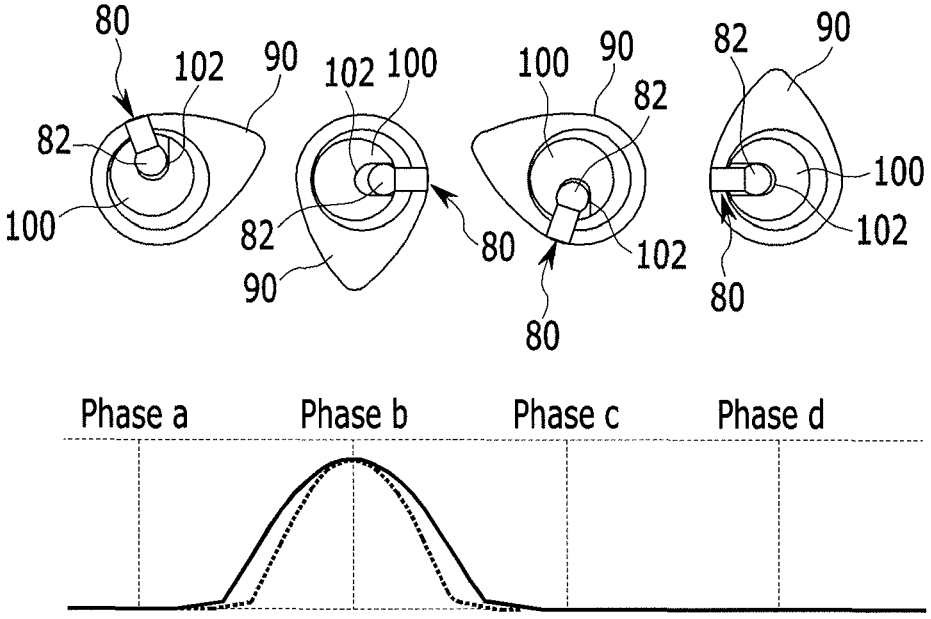
FIG. 4 is a drawing showing valve duration change according to an operation of a continuous variable valve duration apparatus according to an exemplary embodiment of the present invention.

FIG. 4 is a drawing showing valve duration change according to an operation of a continuous variable valve duration apparatus according to an exemplary embodiment of the present invention.

Referring to FIG. 4, a guide hole 102 is formed to a camshaft 100, and a first end of a connecting link 80 is fixed to a cam 90, and a pivot head 82 is formed to a second end of the connecting link 80, and the pivot head 82 is pivotally and slidably inserted into the guide hole 102.

As shown in FIG. 4, when relative distance between the rotation centers of the camshaft 100 and the cam 90 is changed, while the rotation speed of the camshaft 100 is constant, the rotation speed of the cam 90 is variable.

In FIG. 4, while the phase angle of the camshaft 100 is changed at 90 degree, the rotation speed of the cam 90 is relatively faster than rotation speed of the camshaft 100 from phase a to phase b and from phase b to phase c, then the rotation speed of the cam 90 is relatively slower than rotation speed of the camshaft 100 from phase c to phase d and from phase d to phase a. That is, the valve duration is changed.

That is, while a general valve profile is realized as shown in solid line, however, at a short duration mode, the valve duration is changed as shown in dotted line.

Figure 5:
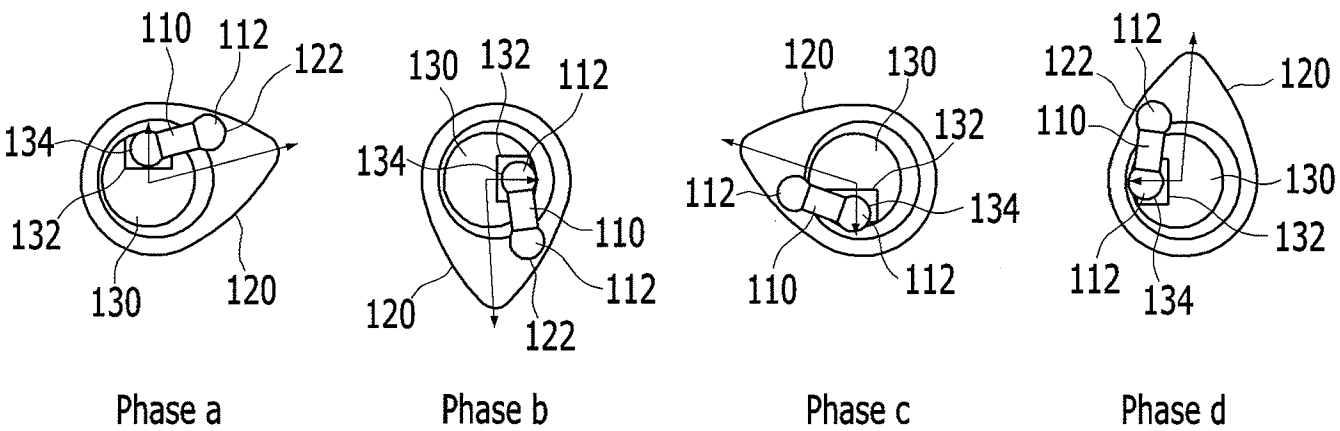
FIG. 5 and FIG. 6 are drawings showing other exemplary connecting link applied to a continuous variable valve duration apparatus according to an exemplary embodiment of the present invention.
Figure 6:
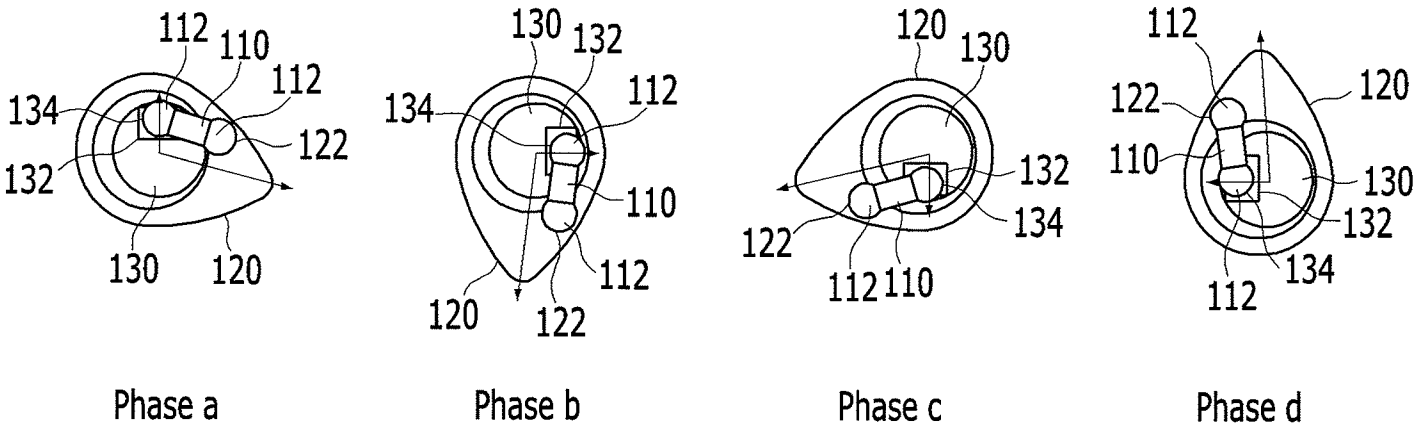

FIG. 5 and FIG. 6 are drawings showing other exemplary connecting link applied to a continuous variable valve duration apparatus according to an exemplary embodiment of the present invention.

FIG. 5 and referring to FIG. 6, pivot holes 134 and 122 are formed to a camshaft 130 and a cam 120 respectively, and pivot heads 112 are formed to both ends of a connecting link 110 and are pivotally inserted into the pivot holes 134 and 122 respectively.

Process for forming the pivot holes to the camshaft 130 may not be easily performed, and thus a pivot cap 132 where the pivot hole 134 is formed thereto may be connected to the camshaft 130 for easy manufacturing and the pivot head 112 may be inserted into the pivot holes 134 and 122 respectively.

FIG. 5 and FIG. 6 are drawings showing other exemplary connecting link applied to a continuous variable valve duration apparatus according to an exemplary embodiment of the present invention showing short duration and long duration respectively.

As shown in FIG. 5, the relative rotation speed of the cam 120 is faster than the rotation speed of the camshaft 130 from phase a to phase b and from phase b to phase c, and then the relative rotation speed of the cam 120 is slower than the rotation speed of the camshaft 130 from phase c to phase d and from phase d to phase a according to the relative position of the camshaft 130 and the cam 120, so that the short duration is realized.

As shown in FIG. 6, the relative rotation speed of the cam 120 is slower than the rotation speed of the camshaft 130 from phase a to phase b and from phase b to phase c, and then the relative rotation speed of the cam 120 is faster than the rotation speed of the camshaft 130 from phase c to phase d and from phase d to phase a according to the relative position of the camshaft 130 and the cam 120, so that the long duration is realized.

Figure 7:
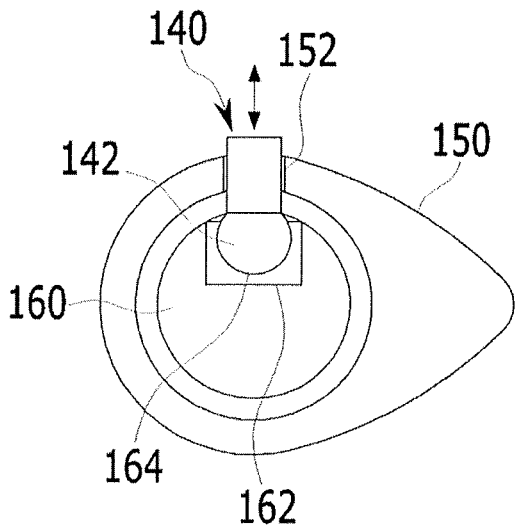
FIG. 7 and FIG. 8 are drawings showing other exemplary connecting link applied to a continuous variable valve duration apparatus according to an exemplary embodiment of the present invention.
Figure 8:
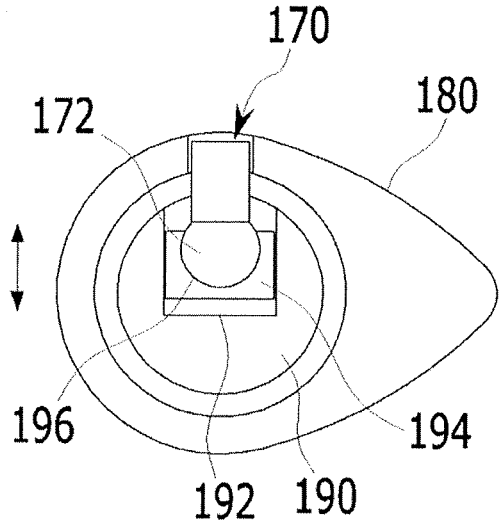

FIG. 7 and FIG. 8 are drawings showing other exemplary connecting link applied to a continuous variable valve duration apparatus according to an exemplary embodiment of the present invention.

As shown in FIG. 7, a guide slot 152 is formed to a cam 150, a pivot hole 164 is formed to a camshaft 160, and a first end of a connecting link 140 is slidably inserted into the guide slot 152, and a pivot head 142 is formed to a second end of the connecting link 140, and the pivot head 142 is pivotally inserted into the pivot hole 164.

Process for forming the pivot hole to the camshaft 160 may not be easily performed, and thus a pivot cap 162 where the pivot hole 164 is formed thereto may be connected to the camshaft 160 for easy manufacturing and the pivot head 142 may be inserted into the pivot hole 164.

As shown in FIG. 8, a guide slot 192 may be formed to a camshaft 190, a pivot cap 194, where a pivot hole 196 is formed thereto, may be slidably inserted into the guide slot 192, and a first end of a connecting link 170 may be fixed to a cam 180, and a pivot head 172 may be formed to a second end of the connecting link 170, and the pivot head 172 may be pivotally inserted into the pivot hole 196.

The connecting link 140 and 170 as shown in FIG. 7 and FIG. 8 may be slidably and/or pivotally connected to the cam 150 and 180 and the camshaft 160 and 190 respectively, thus relative rotation speed of the cam 150 and 180 with respect to the camshaft 160 and 190 may be variable. So the valve duration may be variable according to the changing of relative rotation centers between the camshaft 160 and 190 and the cam 150 and 180.

As described above, the continuous variable valve duration apparatus according to the exemplary embodiments of the present invention may change the valve duration using the simple connecting link so as to enhance fuel consumption efficiency and performance of an engine.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration apparatus comprising:

a cam shaft rotatably mounted to a cam carrier;

a cam which is disposed to the cam shaft and relatively rotatable with respect to the cam shaft, and of which a rotation center thereof is variable with respect to a rotation center of the cam shaft;

a connecting link disposed between and connected to both of the cam and the camshaft and aligned in a radial direction of the cam shaft, wherein at least one end of the connecting link is pivotally connected to at least one of an inner circumferential portion of the cam and an outer circumferential portion of the camshaft, and transmits rotation of the camshaft to the cam; and a control portion selectively changes the rotation center of the cam.

2. The continuous variable valve duration apparatus of claim 1, wherein a cam support shaped as a cylinder is formed to the cam; and wherein the control portion comprises:

a guide plate; and a control plate including a cam bearing of which the cam support is rotatably connected thereto, wherein the control plate selectively moves along the guide plate.

3. The continuous variable valve duration apparatus of claim 2, wherein the guide plate is connected to the cam carrier, and the cam shaft is connected between the cam carrier and the guide plate.

4. The continuous variable valve duration apparatus of claim 3, wherein a guide pin is formed to one of the control plate and the guide plate; and wherein a guide rail guiding the guide pin is formed to the other one of the control plate and the guide plate.

5. The continuous variable valve duration apparatus of claim 2, wherein the control portion further includes a control shaft which is parallel to the camshaft and of which an eccentric cam is mounted thereto, and wherein a control slot is formed to the control plate for the eccentric cam to be inserted thereto and engaged thereto, and a relative position of the control plate with respect to the guide plate is changeable according to rotation of the control shaft.

6. The continuous variable valve duration apparatus of claim 5, wherein the guide plate is connected to the cam carrier, and the control shaft is connected between the guide plate and the cam carrier through a control shaft bearing.

7. The continuous variable valve duration apparatus of claim 1, wherein a guide hole is formed to the cam; and wherein a first end of the connecting link is fixed to the camshaft, and a pivot head is formed to a second end of the connecting link, and the pivot head is pivotally and slidably inserted into the guide hole.

8. The continuous variable valve duration apparatus of claim 1, wherein a guide hole is formed to the camshaft; and wherein a first end of the connecting link is fixed to the cam, and a pivot head is formed to a second end of the connecting link, and the pivot head is pivotally and slidably inserted into the guide hole.

9. The continuous variable valve duration apparatus of claim 1, wherein pivot holes are formed to the camshaft and the cam respectively; and wherein pivot heads are formed to both ends of the connecting link and are pivotally inserted into the pivot holes respectively.

10. The continuous variable valve duration apparatus of claim 1, wherein a first pivot hole is formed to the cam;

wherein a pivot cap, where a second pivot hole is formed thereto, is connected to the camshaft; and wherein pivot heads are formed to both ends of the connecting link and are pivotally inserted into the first and second pivot holes respectively.

11. The continuous variable valve duration apparatus of claim 1, wherein a guide slot is formed to the cam;

wherein a pivot hole is formed to the camshaft; and wherein a first end of the connecting link is slidably inserted into the guide slot, and a pivot head is formed to a second end of the connecting link, and the pivot head is pivotally inserted into the pivot hole.

12. The continuous variable valve duration apparatus of claim 1, wherein a guide slot is formed to the cam;

wherein a pivot cap, where a pivot hole is formed thereto, is connected to the camshaft; and wherein a first end of the connecting link is slidably inserted into the guide slot, and a pivot head is formed to a second end of the connecting link, and the pivot head is pivotally inserted into the pivot hole.

13. The continuous variable valve duration apparatus of claim 1, wherein a guide slot is formed to the camshaft;

wherein a pivot cap, where a pivot hole is formed thereto, is slidably inserted into the guide slot; and wherein a first end of the connecting link is fixed to the cam, and a pivot head is formed to a second end of the connecting link, and the pivot head is pivotally inserted into the pivot hole.

14. The continuous variable valve duration apparatus of claim 1, wherein an entire body of the connecting link is aligned in the radial direction from the camshaft.

15. The continuous variable valve duration apparatus of claim 14, wherein the entire body of the connecting link is disposed inside the cam and aligned in the radial direction from the camshaft.

16. The continuous variable valve duration apparatus of claim 14, wherein a first end of the connecting link coupled to the cam, is disposed inside the cam.

* * * * *